US007762228B2

(12) United States Patent
Georgiev

(10) Patent No.: US 7,762,228 B2
(45) Date of Patent: Jul. 27, 2010

(54) DEVICE-OPERATING MODULE

(76) Inventor: Lyubcho Kirilov Georgiev, BI. 527, h.k. Liulin, ap. 17, Sofia (BG) 1359

( * ) Notice: Subject to any disclaimer, the term of this patent is extended or adjusted under 35 U.S.C. 154(b) by 676 days.

(21) Appl. No.: 11/570,032

(22) PCT Filed: Nov. 5, 2004

(86) PCT No.: PCT/BG2004/000021

§ 371 (c)(1),
(2), (4) Date: Dec. 4, 2006

(87) PCT Pub. No.: WO2006/000067

PCT Pub. Date: Jan. 5, 2006

(65) Prior Publication Data

US 2008/0044306 A1 Feb. 21, 2008

(30) Foreign Application Priority Data

Jun. 24, 2004 (BG) ..... 108771

(51) Int. Cl.

| | |
|---|---|
| ***F02B 53/00*** | (2006.01) |
| ***F01C 21/08*** | (2006.01) |
| ***F01C 21/00*** | (2006.01) |
| ***F04C 18/356*** | (2006.01) |
| ***F04C 27/00*** | (2006.01) |

(52) U.S. Cl. ..... 123/236; 123/234; 123/235; 418/61.1; 418/227

(58) Field of Classification Search ..... 123/235–237, 123/204; 418/227; *F01C 21/08, 21/00; F04C 18/356, F04C 27/00*

See application file for complete search history.

(56) References Cited

U.S. PATENT DOCUMENTS

| | | | | | |
|---|---|---|---|---|---|
| 1,864,406 | A | * | 6/1932 | Christ | 123/236 |
| 2,040,036 | A | * | 5/1936 | Weeks | 123/236 |
| 2,344,159 | A | * | 3/1944 | Meeks | 123/234 |
| 2,856,119 | A | * | 10/1958 | Smith | 418/61.1 |
| 2,966,898 | A | * | 1/1961 | Jacobs et al. | 123/235 |
| 3,487,816 | A | * | 1/1970 | Mezei et al. | 123/235 |

(Continued)

FOREIGN PATENT DOCUMENTS

| | | |
|---|---|---|
| CH | 223597 | 7/1938 |

(Continued)

OTHER PUBLICATIONS

A Fully English Certified Translation CH 223 597 A, published on Sep. 30, 1942.*

*Primary Examiner*—Thai Ba Trieu
(74) *Attorney, Agent, or Firm*—Barkume & Associates, P.C.

(57) ABSTRACT

The rotary-piston machine consists of two operating units. The first one comprises a horizontal operating cylinder (1) with cylindrical shaft (5), connected to the main shaft (4) and sealed with rings to the walls of the cylinder (1). The shaft (5) has a first friction element (9) pressed against the internal wall of the cylinder (1). The second unit comprises a cylindrical body (15) mounted to the main shaft (4) with a firmly connected to its circumference inner ring (16) of a bearing with an outer ring (17) provided of an articulated joint (18) connected to a frame (19) that is connected to a valve (13) which press a second friction element (14) to the shaft (5). Both units move in synchronization.

7 Claims, 9 Drawing Sheets

U.S. PATENT DOCUMENTS 3,682,566 A * 8/1972 Nakamura ..... 123/237
3,809,024 A 5/1974 Abbey ..... 123/244
3,839,995 A * 10/1974 Williams ..... 123/234
3,882,827 A * 5/1975 Williams ..... 123/228
3,918,414 A * 11/1975 Hughes ..... 123/230
3,989,011 A * 11/1976 Takahashi ..... 123/204
3,993,029 A * 11/1976 Eiermann et al. ..... 123/203
4,585,404 A * 4/1986 Barata ..... 418/61.1
4,915,071 A * 4/1990 Hansen ..... 123/242
7,117,839 B2 * 10/2006 Horstin ..... 123/236

FOREIGN PATENT DOCUMENTS

DE 4439915 A1 * 5/1996

* cited by examiner

DEVICE-OPERATING MODULE

BACKGROUND OF THE INVENTION

The invention is referred to a device-operating module intended to be an indivisible and main part of an active and/or passive machine of the type of piston internal combustion engine, pump, compressor or turbine, as well as rotation engine.

A device-operating module is known in the art, especially for internal combustion engine, that comprises a horizontal operating cylinder with intake and exhaust pipes in its casing, respectively for fluid intake and outlet. In the internal combustion engine those are the exhaust gases that expand through the horizontal operating cylinder. A main shaft is mounted on bearings in the horizontal operating cylinder with a fixed to it elliptical body that on one side while rotating abuts firmly internal cylindrical surface of the horizontal operating cylinder, and on the other is vertically pressed by a second cylindrical body.

Thus in the horizontal operating cylinder are formed two chambers isolated from one another that constantly change their volume. The elliptical operating body and the second cylindrical body work together, and notched wheels are externally fixed to them and engaged in between. The second operating body is tightly mounted on bearings in a driving head, slide mounted in the engine cylinder block, the driving head is connected to the engine piston and when displaced transfers the movement through the second cylindrical body to the elliptical operating body. With the rotation of the main shaft by the piston movement as a result of the combustion process carried out, when the bottom dead centre (BDC) of the piston is reached, it opens the input pipe of the horizontal operating cylinder and the exhaust gases pass to one of the chambers formed, exercising additional pressure over the elliptical body giving it additional rotation leading to the increase of the driving torque received in the main shaft. (1)

The operating module described above may be used only and solely for a piston internal combustion engine. Besides, the force transfer from the piston to the operating body in the horizontal operating cylinder is made by a gearing that has a low efficiency rate and simultaneously helps increase the inertia forces in the piston due to the additional mass of the gearing. The elliptical body is submitted to intensive wear which causes the more frequent replacement of a basic element of the module, and its sealing towards the internal surface of the horizontal operating cylinder, especially in case of temperature deformation, is a problem.

TECHNICAL DESCRIPTION OF THE INVENTION

The main purpose of the invention is to create an operating module for a device that can be used in different kinds of machines by multiplying its different parts, by making maximum use of the energy supplied to the module. The device-operating module comprises a horizontal operating cylinder with intake and exhaust pipe for supply and discharge of fluid, respectively. A main shaft is mounted on bearings in the horizontal operating cylinder with a fixed to it operating body that on one side while rotating abuts firmly the internal cylindrical surface of the horizontal operating cylinder, and on the other is vertically pressed by a second body, thus forming two chambers in the horizontal operating cylinder, isolated one from another that constantly change their volume. According to the invention the horizontal operating cylinder is placed isolated in a common casing of a crankcase of the operating module and the main shaft is mounted on bearings in the walls of the horizontal operating cylinder, as well as in the walls of the common casing. In the crankcase, additionally to the horizontal operating cylinder there is at least one cylindrical body mounted in an eccentric and fixed way to the main shaft with an inner ring of a friction bearing firmly connected to its circumference which outer ring is provided of articulation joint fixed to a frame, where is also fixed a second body that is always abutting the operating body of the horizontal operating cylinder. Counterweights are mounted to the main shaft, and the operating body is a cylindrical shaft of an eccentric and fixed connection to the main shaft and sealed with a small and a large sealing gaskets to the vertical walls of the horizontal operating cylinder. The cylindrical shaft is provided of a subspring first friction element pressed to the internal cylindrical wall of the horizontal operating cylinder, and in a midcase is made a vertical groove, placed over the horizontal operating cylinder and fixed to it between the orifices of the intake and exhaust pipes, in which groove is placed the second body with the shape of a valve, fixed to the frame and constantly pressing to the cylindrical shaft second friction element, connected with a subspring to the valve.

Preferably, the horizontal operating cylinder with the cylindrical shaft of eccentric and fixed connection to the main shaft, sealed with a small and large sealing rings to the vertical walls of the horizontal operating cylinder that is provided by a pressed to the inner side of the horizontal operating cylinder subspring first friction element are grouped in a 'first operating unit' of the module. The cylindrical body, mounted in an eccentric and fixed way to the main shaft with a firmly connected to its circumference inner ring of a friction bearing with an outer ring provided of an articulation joint are grouped in a 'second operating unit' of the module.

In a preferred embodiment in the cylinder space of the horizontal operating cylinder, to it, in the section of the second friction element and to the cylindrical shaft in the section of the first friction element are considered opposed and penetrating each other transverse bands that cover the friction elements when one over the other.

It is very suitable the first friction element to be attached to a bed of the cylindrical shaft by a fixed to it bottom strip where a collapsible thrust strip with profile guides lays, the guides corresponding to profile notches in the first friction element, and two first sets are mounted to the thrust strip, comprising of a located one over the other cap, spring and a cup to which is abutted a support cylinder fixed to the first friction element. On the bottoms part of the cylindrical shaft, the first friction element has a sealing plate held pressed to the horizontal operating cylinder by means of elastic wafer.

This way in the second friction element are attached two more second sets cap, spring and cup, the cup being connected to the second friction element, and the support cylinders are placed tightly in guiding grooves of the valve that is sealed in its groove by two opposite sealing plates, supported in a pressed position by elastic wafers.

A substantial requisite for the reliable operation of the module is the radius R4 followed by the axis of the articulation joint of the second unit: it should be equal to the radius of the cylindrical shaft of the first operating unit, and the cylindrical body of radius R3 of the second operating unit should be constantly placed during its motion under the axis of the articulation joint. The centre of the cylindrical body follows a radius R5 during its rotation movement. The outer radius of the horizontal operating cylinder is determined by the equation: R1=R4+R5. The axis of the articulation joint is located in a vertical plane at an eccentricity distance E of the vertical plane where the axis of the main shaft is mounted.

The device-operating module is an indivisible part of an internal combustion engine using the extension of the burnt gases and is a first embodiment of the module's application. In this embodiment, in a common casing of the module are mounted a first operating unit with two second operating units placed symmetrically on each side. Between every two second operating units there is a counterweight fixed to the main shaft, and their articulation joints are attached to piston skirts, denominated compression pistons, mounted in a cylinder block. The compression pistons are fixed to the frame to which is also connected a so-called operating piston, located in a cylinder block over the first operating unit, constantly pressing to the cylindrical shaft the valve with second friction element mounted in a groove of the midcase. The frame is placed in the cylinder head of the cylinder block and a camshaft is mounted beneath, to which suction valves of the end compression cylinders and suction valves of the middle vertical operating cylinder are attached. The suction valves of the vertical operating cylinder are connected through suction gullies with compression valves provided in the compression cylinders, the camshaft being connected by means of gear to the main shaft.

The device-operating module is an indivisible part of an internal combustion engine using a continuous expansion of the burnt gases and is a second embodiment of application of the module. In this embodiment, in the common casing of the module are mounted: a first operating unit and one second operating unit symmetrically mounted on each side. Symmetrically on both sides of the second operating units to the main shaft are fixed counterweights, and the articulation joints of the second operating units are connected to the frame, which is horizontally mounted in a cylinder block, and the pistons of three cylinders are attached to it, the middle one being a vertical operating, and the end ones being compression. The frame is placed in the subpiston space and is common for the three pistons and it is detached from the crankcase by a horizontal base in the common casing, through this base pass sealed hard connections that are part of the frame and are oriented along the piston axis, a cylinder head of the cylinder block shaped over them, where a camshaft is mounted to which are attached suction valves for the compression cylinders and suction valves of the vertical operating cylinder. The suction valves of the vertical operating cylinder are connected through suction gullies with compression valves in the compression cylinders. The camshaft is connected to the main shaft by a gear. Under the horizontal base, along the piston axis of the vertical operating cylinder and connected to it is a valve placed in a groove of the midcase, constantly pressing the second friction element to the cylindrical shaft of the first operating unit.

The device-operating module is an indivisible part of an active or passive machine and is a third embodiment of the application of the module. With this embodiment, in the common casing of the module are mounted a first operating unit with a symmetrically attached one second operating unit on each side. Externally, on the second operating units to the main shaft are fixed counterweights, and the articulation joints of the second operating units are attached to the frame by means of elongations shaped. The frame is mounted by means of elastic connections horizontally in a head, and the elongations are placed on a slide connection in vertical grooves, shaped in the head's body and in a midcase, in which symmetrically between the vertical grooves is shaped a guiding gully with a piston placed in it, fixed to the frame and constantly pressing the second friction element to the cylindrical shaft of the first operating unit. In the upper part of the valve there is a through hole that regulates the fluid flow in the intake pipe, horizontally traced through the midcase.

A device-operating module is an indivisible part of a rotation engine and is a fourth embodiment of the invention. In this embodiment, four counterweights are fixed to the main shaft, two of them are located on both sides of the second operating unit, and the other two are located externally to the first operating units and over the common casing is fixed firmly a midcase an a head over it. One of the two operating units is a compression one, and the other is an expanding unit; the midcase contains the intake and exhaust pipes of the horizontal operating cylinders, as well as the groove for the valve with the second friction element, constantly pressed by the frame against the cylindrical shaft of the horizontal operating cylinder. The frame is sliding free in the head, and the intake pipe of the first operating compression unit is connected through a first air-duct with an air filter, and its exhaust pipe is connected through a pressure channel with a suction valve of a combustion chamber shaped in the head where a spark plug and a nozzle for fuel supply are provided. The horizontal operating cylinder of the expanding first operating unit is connected to the combustion chamber through its intake pipe, a rotation valve and a relief channel.

In a preferred embodiment the head is detached from the midcase by means of a support plate, and the suction valve of the combustion chamber is driven by a camshaft connected with a gear to the main shaft.

The rotation valve may preferably be fixed to a driving shaft that is included to the gear connecting the main shaft with the camshaft. The body of the rotation valve is a triangle and its vertex angle $2\alpha$ in the rotation axis is equal to the angle defined by the holes of the intake and exhaust pipe forming a vertex in the main shaft.

With the device-operating module according the invention has been created a universal structure that may be successfully used not only with the active machines like piston and rotation internal combustion engines, but with the passive machines, like pumps and compressors, too. The distribution of the processes in two separate but mutually connected operating units makes it possible use the energy of the exhaust gases throughout their continuing expansion in the so-called horizontal operating cylinder for the piston internal combustion engines. As far as the rotation engines are concerned, a higher compression is obtained by using two units of the first operating kind, one being a compression unit, and the other being an expansion unit. The processes are divided and combined by the combustion chamber. Simultaneously the inertia force of the second operating unit is used, which makes possible the increase of the engine efficiency. With the passive type of machines: pump and compressor, as well as the turbine as an active machine, the combination of both operating units allows also the achievement of a higher efficiency rate. The role of the inertia forces obtained during rotation of the cylindrical body and the oscillating movement of the articulation joint is substantial too.

DESCRIPTION OF THE PREFERRED EMBODIMENT

Figure 2:
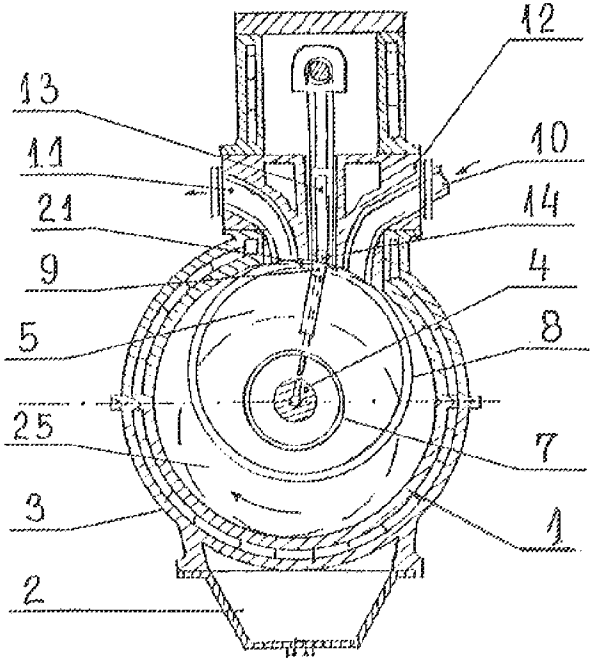
FIG. 2 is a cross-section of the module in the first operating unit.
Figure 1:
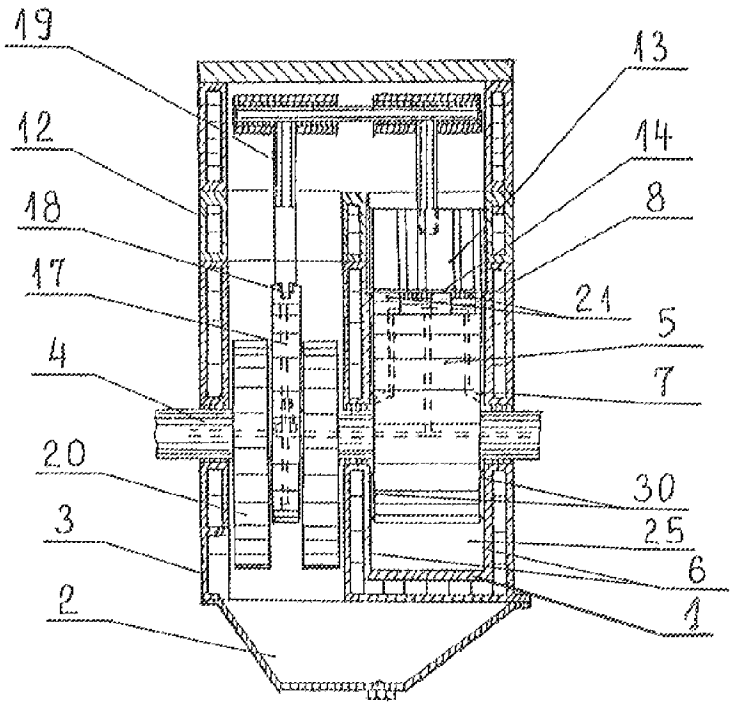
FIG. 1 is a longitudinal section of the module according to the invention.
Figure 3:
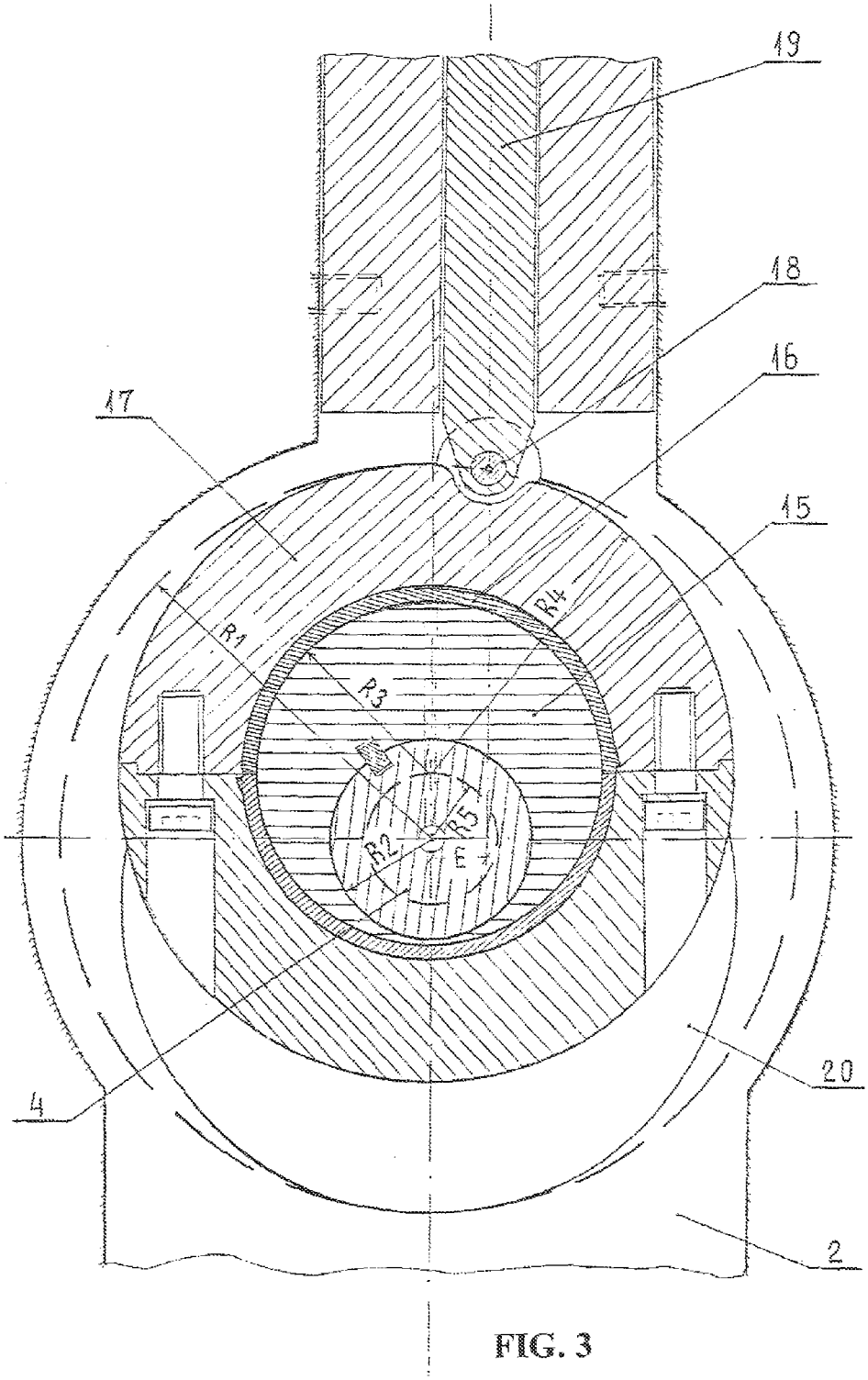
FIG. 3 is a cross-section of the module in the second operating unit.
Figure 4:
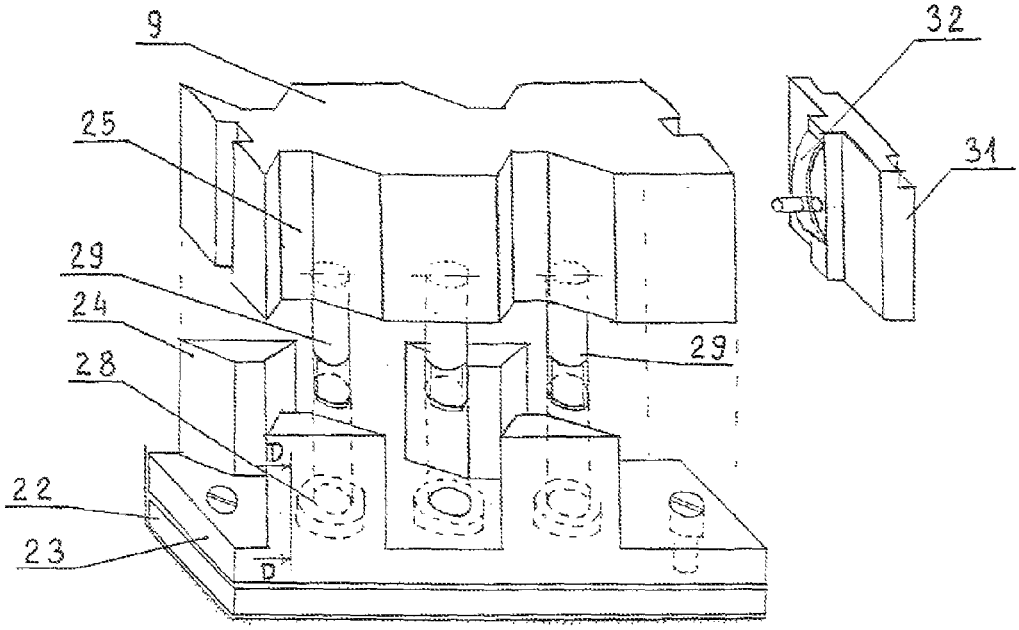
FIG. 4 is an axonometric drawing of the unit with the first friction element.
Figure 5:
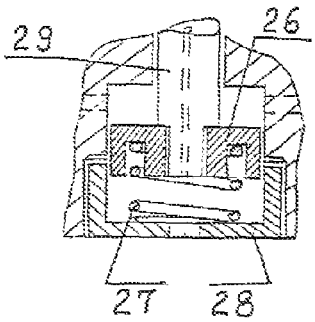
FIG. 5 is a part section D-D of FIG. 4.
Figure 7:
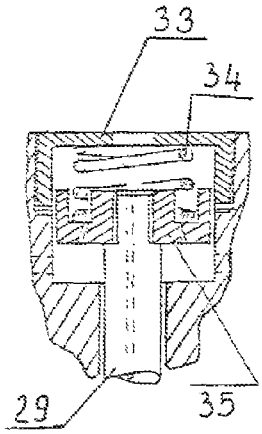
FIG. 7 is a part section E-E of FIG. 6.
Figure 6:
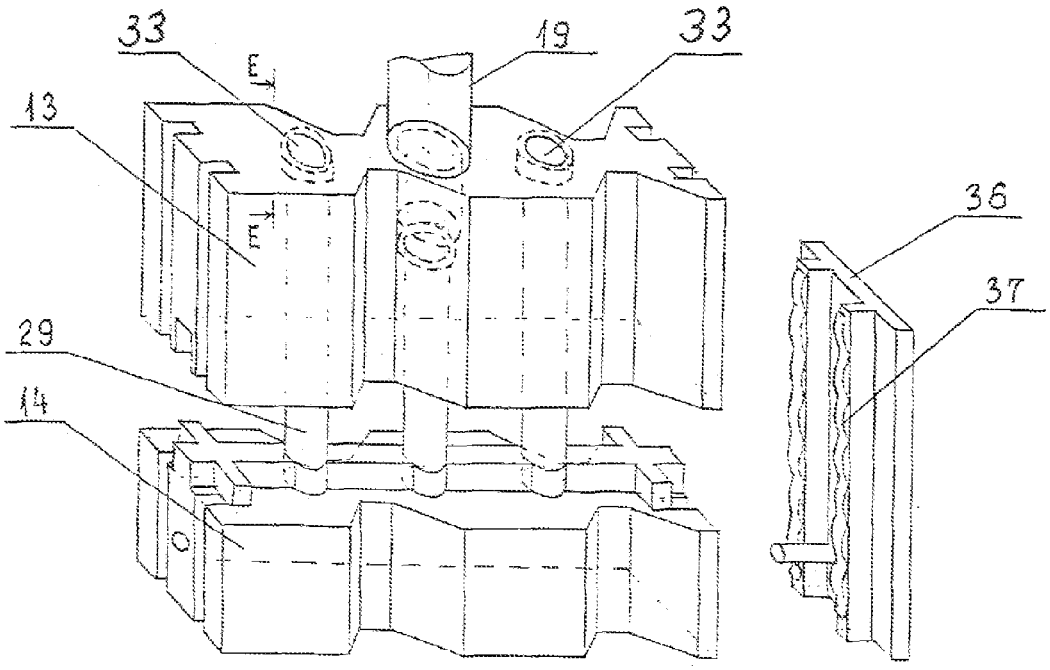
FIG. 6 is axonometric drawing of the unit with the second friction element.
Figure 8:
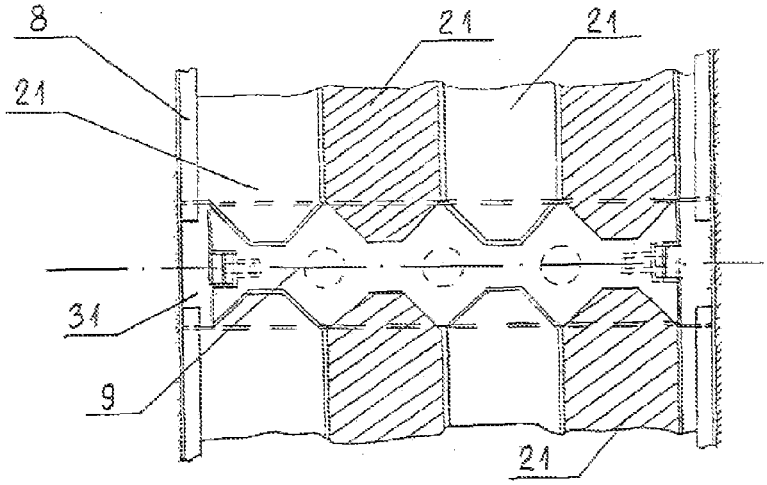
FIG. 8 is a relative position of both friction elements in coincident operation and the participation of the overlapping bands.

A device-operating module according to the invention described on FIGS. 1 to 3 comprising a horizontal operating cylinder 1, placed in a crankcase 2 of a common casing 3 where in the horizontal operating cylinder 1 is mounted on bearings a main shaft 4. To the main shaft 4 in the horizontal operating cylinder 1 is fixed and eccentrically mounted a cylindrical shaft 5 that is sealed to the lateral walls 6 of the horizontal operating cylinder 1 by means of a small 7 and large 8 sealing rings. In the cylindrical shaft 5 is radially mounted subspring and sealed first friction element 9, constantly abutting during the rotation of the cylindrical shaft 5 to the internal cylindrical surface of the horizontal operating cylinder 1. The inner space of the horizontal operating cylinder 1 is connected to an intake 10 and exhaust 11 pipes. Through a midcase 12, connected to the common casing 3 pass the channels of the pipes 10 and 11, and between them is shaped a guiding groove for a sealed valve 13 located therein, that constantly abuts to the cylindrical shaft 5 by means of a second friction element 14. Thus in the horizontal operating cylinder 1 are formed two chambers isolated one from another that constantly change their volume. Additionally to the horizontal operating cylinder 1 in the crankcase 2 to the main shaft 4 is mounted in an eccentric and fixed way at least one cylindrical body 15 with tightly attached along its circumference inner ring 16 of a friction bearing with an external ring 17 provided of articulated joint 18 fixed to a frame 19 placed in the upper part of the module. To the frame 19 is also attached the valve 13 supporting and constantly pressing the second friction element 14 in the cylindrical shaft 5 of the horizontal operating cylinder 1. Counterweights 20 are mounted to the main shaft 4.

To achieve a reliable detachment of the two chambers formed in the cylinder space of the horizontal operating cylinder 1, to it and in the area of the second friction element 14 and to the cylindrical shaft 5 in the area of the first friction element, are provided opposing and interpenetrating guiding bands 21 that overlap the friction elements 9 and 14 that are one over the other. Part of the guiding bands 21 are attached to the inner surface of the horizontal operating cylinder 1 on both sides of the second friction element 14, and the other opposing part that interpenetrates the guiding bands of the first part are secured to the cylindrical shaft 5 on both sides of the first friction element 9.

The first friction element 9 is secured to a bed of the cylindrical shaft 1 by means of a fixed to it bottom strip 22 where a collapsible thrust strip 23 with profile guides 24 lays, the guides corresponding to profile notches 25 in the first friction element 9. Three first sets are mounted to the thrust strip, comprising of a located one over the other cap 26, spring 27 and cup 28 to which is abutted a support cylinder 29 fixed to the first friction element 9. Additionally, on the bottom part 30 of the cylindrical shaft 5, the first friction element 9 has a sealing plate 31 held pressed to the operating cylinder by means of elastic wafer 32. The second friction element 14 is of analogous structure and is also connected under the spring to the valve 13 that is fixed to the frame 19. Another three second sets are attached to the second friction element 14 that are cap 33, spring 34 and cup 35, the cup 35 being attached to the valve 13, and the supporting cylinders 29 are mounted in guiding grooves of the valve 13 and with its other end are fixed to the second friction element 14. The valve 13 is sealed in its groove by two opposite sealing plates 36 supported in a pressed position by elastic wafers 37.

The so described operating module for a device-comprises first operating unit, illustrated on FIG. 2, including the horizontal operating cylinder 1 with the cylindrical shaft 5 of eccentric and fixed connection to the main shaft 4 and sealed with sealing rings 7 and 8 to the vertical walls of the horizontal operating cylinder 1 that is provided of pressed against the inner wall of the horizontal operating cylinder 1 subspring first friction element 9 and second operating unit, illustrated on FIG. 3, including a cylindrical body 15 of eccentric and fixed connection to the main shaft 4 with a attached to its circumference inner ring 16 of friction bearing that has an external ring 17 provided of articulating joint 18.

There are various conditions that determine the operating capacity of the module related to the location of the elements in the second operating unit, the main requisite being that the radius R4 which follows the axis of the articulated joint 18 shall equal the radius of the cylindrical shaft 5 of the first operating unit. The surface of the cylindrical body 15 of a radius R3 of the second operating unit shall remain under the axis of the articulated joint 18. The centre of the cylindrical body 15, mounted in an eccentric and fixed way on the main shaft 4, during its rotations draws a radius R5, and the condition R1=R4+R5 shall be always kept. However the axis of the articulated joint 18 is displaced to an abutting vertical plane with eccentricity E in the common case of the vertical plane where the axis of the main shaft 4 is mounted. For the normal operation of the module the crankcase space 2 shall be larger than the exterior radius R1 of the horizontal operating cylinder 1.

Figure 10:
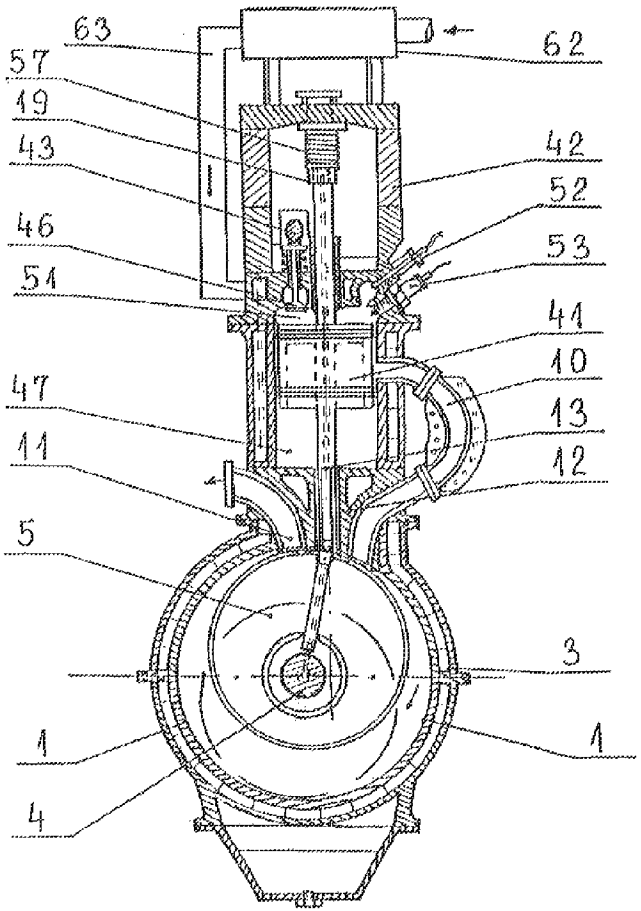
FIG. 10 is a cross section of the first embodiment of the operating module in an internal combustion engine through its first operating unit.
Figure 9:
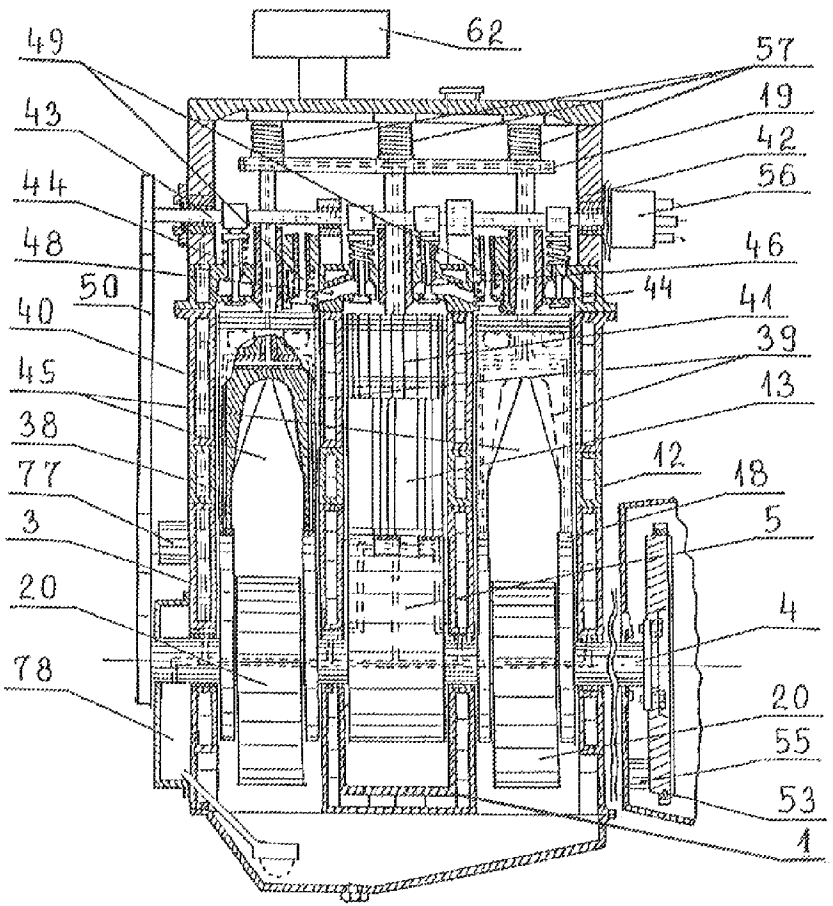
FIG. 9 is a longitudinal section of the first embodiment of the module in an internal combustion engine.

In the first embodiment of the device-operating module illustrated on FIGS. 9 and 10, in the common casing 3 of the module are installed a first operating unit and two second operating units placed symmetrically on each side, and between every two second operating units there is a counterweight 20 fixed to the main shaft 4, and their articulating joints 18 are attached to piston 39 skirts 38, mounted in a cylinder block 40, the pistons 39 being fixed to the frame 19. Another piston 41 is attached to the frame 19, placed in the cylinder block 40 over the first operating unit, constantly pressing against the cylindrical shaft 5 the valve 13. The frame 19 is placed in the cylinder head 42 of the cylinder block 40 and a camshaft 43 is mounted beneath to which suction valves 44 for the end cylinders, called compression 45 and suction valves 46 of the middle vertical operating cylinder 47 are attached through suction gullies 48 with compression valves 49 provided in the compression cylinders 45. The camshaft 43 is connected to the main shaft 4 by a gearing 50. The intake pipe 10 is connected to the overpiston space 51 of the vertical operating cylinder 47 in the zone of the bottom dead centre (BDC). The cylinder head 42 is provided by a nozzle 52 for fuel supply and a spark plug 53. Thus the operating module becomes a part of an internal combustion engine where a continuing expansion of the burnt gases is performed. To have a complete the picture, to the main shaft 4, on one of the exterior parts of the common casing 3 is mounted a flywheel 54 driven by a starter 55. A distributor switch 56 is installed to the camshaft 43. In this embodiment the frame 19 is attached to the upper part of the cylinder head 42 by means of elastic connections 57, i.e. springs working on tension and pressure. Besides, as illustrated on FIG. 10, the so described engine, constructed on the basis of the operating module, has also an air filter 62 that is connected to the suction valves 44 of the compression cylinders 45 through the first airduct 63.

Figure 12:
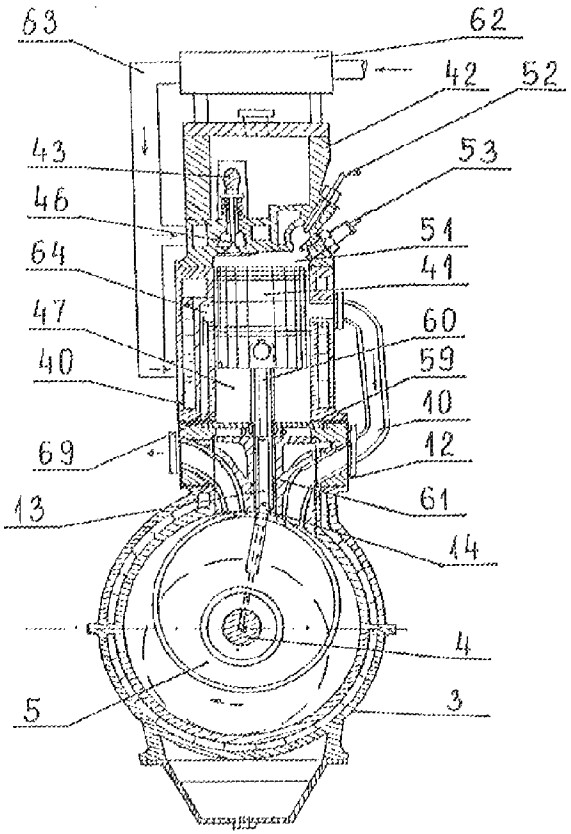
FIG. 12 is a cross-section of the second embodiment of the operating module in an internal combustion engine through the first operating unit.
Figure 11:
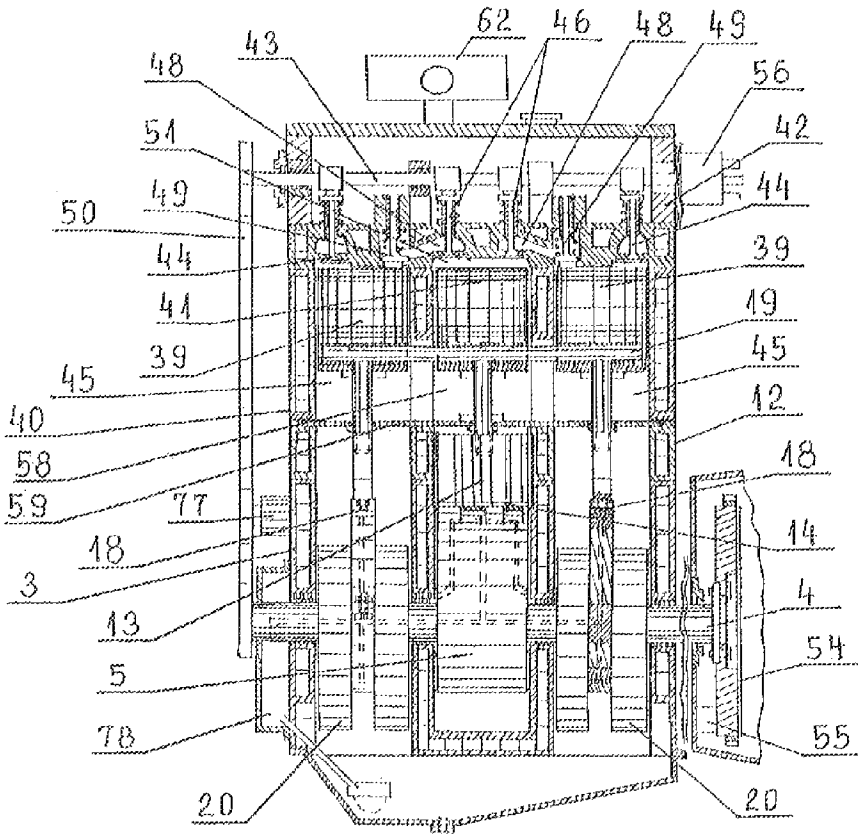
FIG. 11 is a longitudinal section of the second embodiment of the operating module in an internal combustion engine.

In another embodiment of the device-operating module illustrated on FIGS. 11 and 12, in the common casing 3 of the module, are installed one first operating unit and symmetrically on its both sides a second operating unit each, and symmetrically on both sides of the second operating units, counterweights 20 are fixed to the main shaft 4. The articulated joints 18 of the second operating units are attached to the frame 19 that is horizontally mounted in a cylinder block 40 and the operating 41 and the compression 39 pistons of three cylinders are attached to it, the middle cylinder being vertical and operating 47, and the end ones being compression 45. The frame 19 is places in the subpiston space 58 and is common for the three pistons and it is detached from the crankcase 2 of the common casing 3 by a horizontal base 59. Sealed hard connections 60 pass through this base 59, and they are part of the frame 19 and are oriented along the piston axis, the cylinder head 42 of the cylinder block 40 is shaped over them. A camshaft 43 is mounted to the cylinder head 42 and suction valves 44 for the compression cylinders 45 and suction valves 46 of the vertical operating cylinder 47 are attached to this camshaft 43. The suction valves 46 of the vertical operating cylinder 47 are connected through suction gullies 48 with compression valves 49 in the compression cylinders 47. The camshaft 43 is connected to the main shaft 4 by a gearing 50. Under the horizontal base 59, along the piston axis 41 of the vertical operating cylinder 47 and connected to it is a valve 13 placed in a guiding groove 61 of the midcase 12, constantly pressing the second friction element 14 against the cylindrical shaft 5 of the first operating unit.

The intake pipe 10 is connected to the overpiston space 51 of the vertical operating cylinder 47 over the bottom dead centre (BDC). The cylinder head 42 is provided by a nozzle 52 for fuel supply and a spark plug 53. Thus with this operating module and other known in the art construction elements is shaped a version of an internal combustion engine that makes use of the continuing expansion of the burnt gases. To have a complete the picture, to the main shaft 4, on one of the exterior parts of the common casing 3 is mounted a flywheel 54 driven by a starter 55, and a distributor switch 56 is installed to the camshaft 43. Besides, as it is illustrated on FIG. 9, the so described engine, constructed on the basis of the operating module, has also an air filter 62 that is connected, on the one side, to the suction valves 44 of the compression cylinders 45 through the first airduct 63, and on the other side, with the subpiston space 58, and through a second airduct 64, vertically traced in the cylinder block 40, is connected to the overpiston space 51. A lamellar valve 69 is placed in the subpiston space 58 at the input of the second airduct 64 allowing the flow of air mix from the subpiston space 58 to the overpiston space 51 only.

Figure 14:
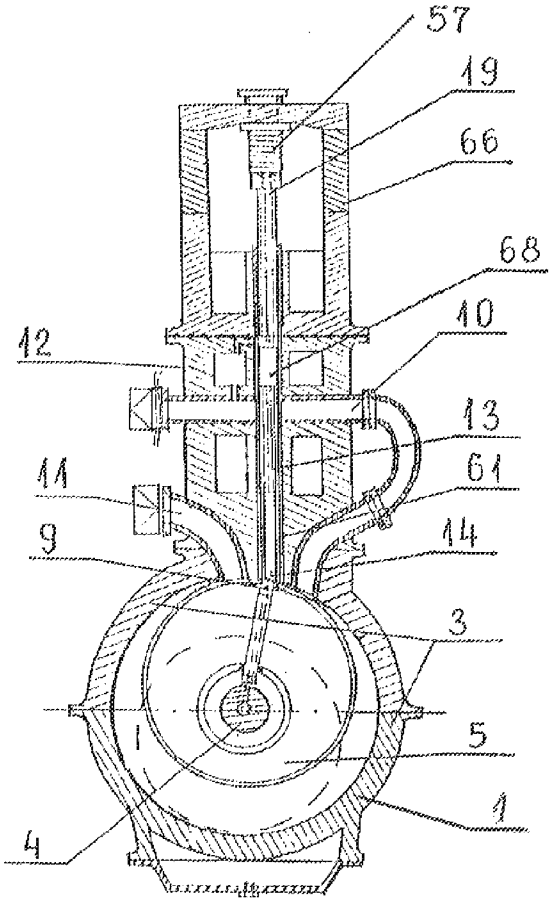
FIG. 14 is a cross section of the first operating package of the third embodiment of the operating module in an active or passive machine.
Figure 13:
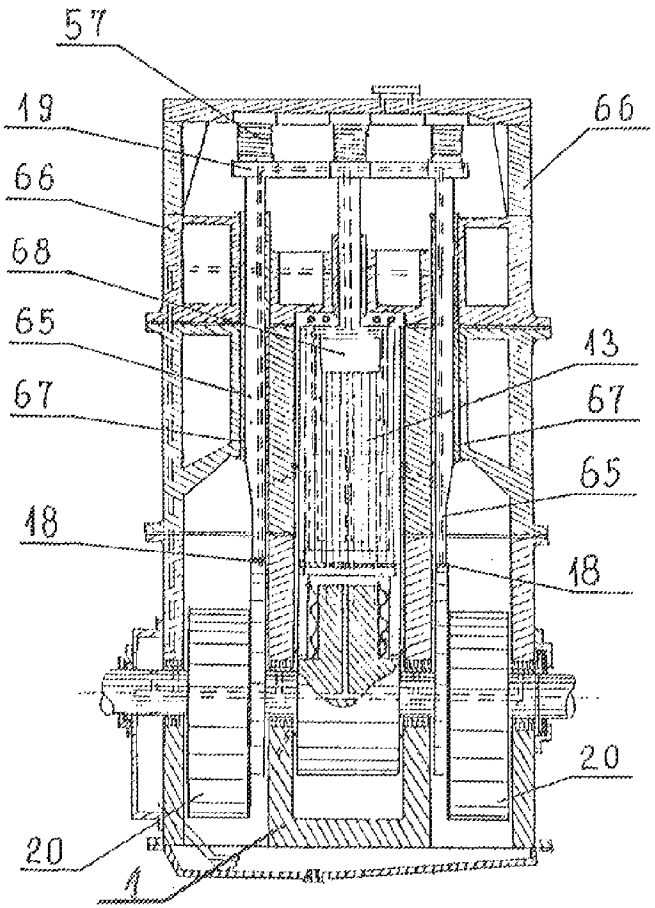
FIG. 13 is a longitudinal section of the third embodiment of the operating module in an active or passive machine.
Figure 16:
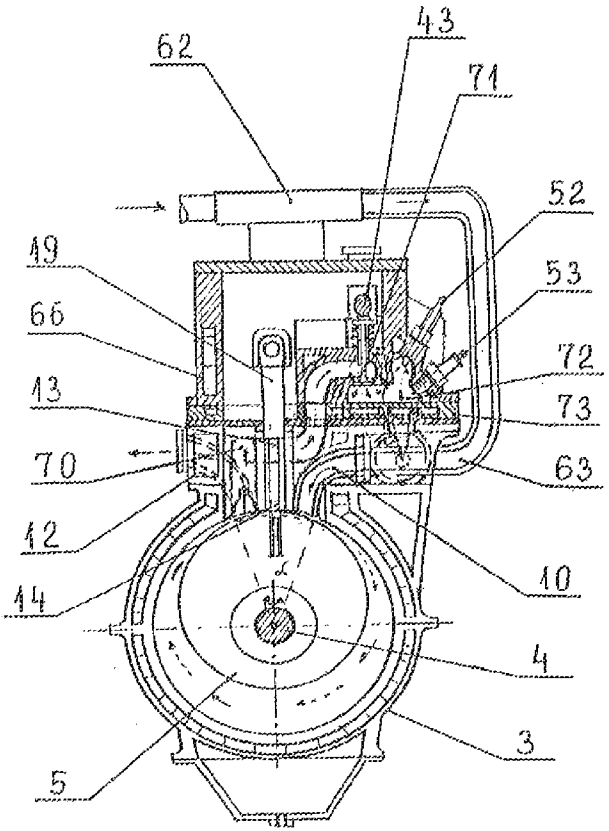
FIG. 16 is a cross-section of a fourth embodiment of the operating module used in a rotation internal combustion engine through the compression first operating unit.
Figure 15:
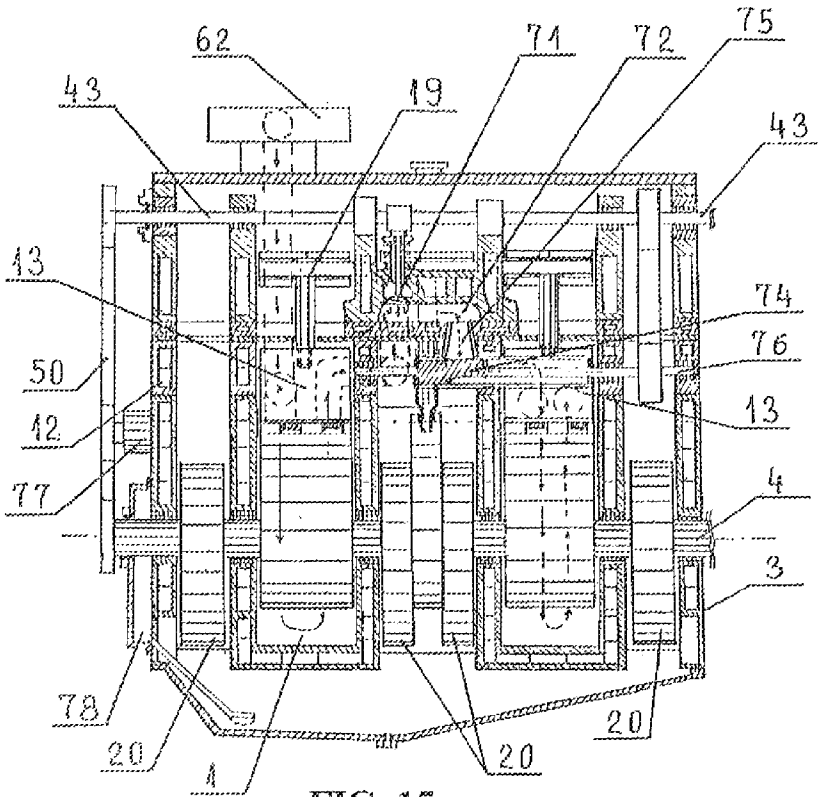
FIG. 15 is a longitudinal section of the fourth embodiment of the operating module used in a rotation internal combustion engine.
Figure 17:
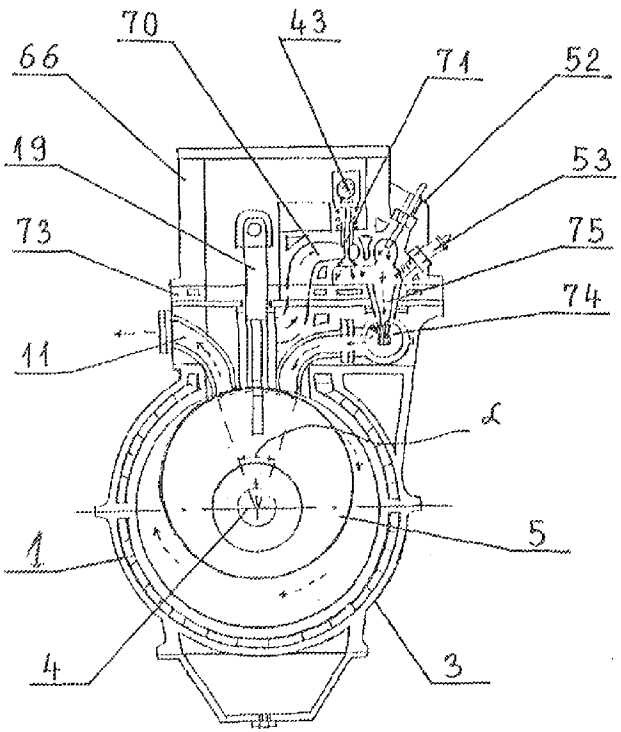
FIG. 17 is a cross section of a fourth embodiment of the operating module in a rotation internal combustion engine through the expansion first operating unit.
Figure 18:
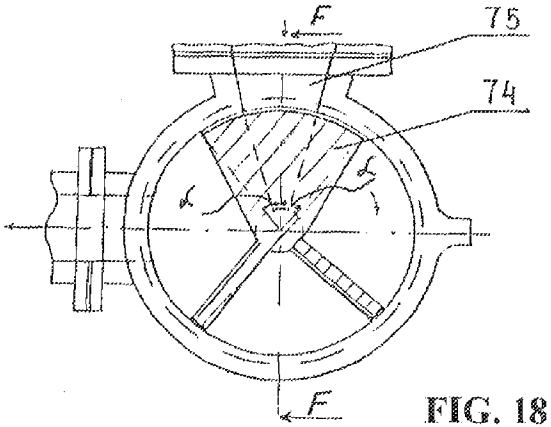
FIG. 18 is a cross-section of a rotation valve.
Figure 19:
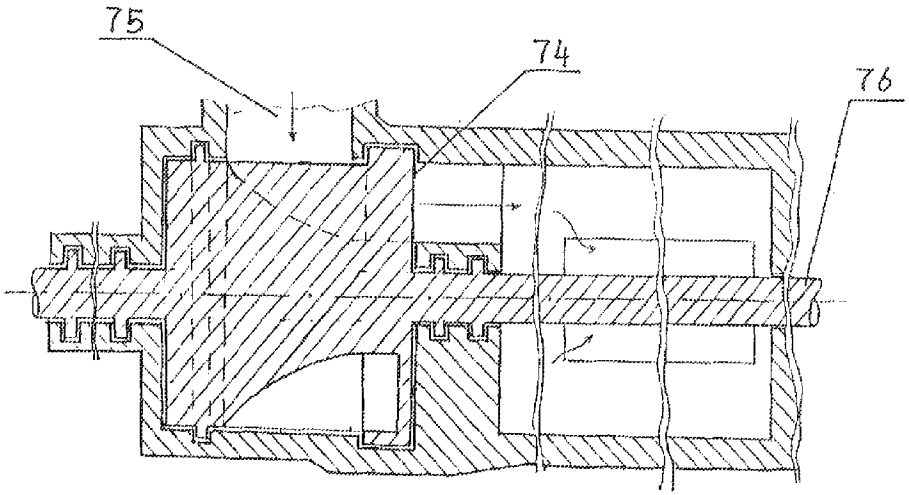
FIG. 19 is a longitudinal-section through a rotation valve.

In a third embodiment of the operating module illustrated on FIGS. 13 and 14, in the common casing 3 of the module are mounted a first operating unit with symmetrically attached one second operating unit on each side, and externally, on the second operating units to the main shaft 4 counterweights 20 are fixed. The articulated joints 18 of the second operating units are attached to the frame 19 by means of elongations 65. The frame 19 is mounted horizontally in a head 66. The elongations 65 are placed on a slide connection in vertical grooves 67 shaped in the head's body 66 and in a midcase 12 where symmetrically between the vertical grooves 67 is shaped a guiding gully 61 with a valve 13 placed in it, connected to the frame and constantly pressing the second friction element to the cylindrical shaft 5 of the first operating unit. In the upper part of the valve 13 there is a through hole 68 that with the valve 13 vertical movement regulates the fluid flow in the intake pipe 10 that in this embodiment is horizontally traced through the midcase 12. Besides, the frame 19 is attached to the head 66 by means of elastic connections 57, i.e. tension and pressure springs. The illustrated on the above-mentioned figures may be used as an active or passive machine, pump or compressor with external driving source of the main shaft 4 and a turbine by using the fluid pressure to rotate the main shaft 4, for which the intake 10 and the exhaust 11 pipes are provided of the corresponding valves (marked with symbols) regulating the fluid flow.

In a fourth embodiment of the device illustrated on FIGS. 15 to 19, the common casing 3 of the module contains two first operating units and one second operating unit between them. Four counterweights 20 are fixed to the main shaft, two of which are placed on both sides of the second operating unit and the other two are located externally to the first operating units. Over the common casing 3 is fixed firmly a midcase 12, and a head 66 over it. The two first operating units have different functions. One is compression, and the other is an expanding unit, and is the main part of the rotation engine. The midcase 12 contains the intake 10 and the exhaust 11 pipes of the horizontal operating cylinders 1, as well as the groove for the valve 13 with the second friction element 14, constantly pressed by the frame 19 against the cylindrical shaft 5 of the horizontal operating cylinder 1. The frame 19 is sliding free in the head 66. The intake pipe 10 of the first operating compression unit is connected through a first airduct 63 with an air filter 62, and its exhaust pipe 11 is connected through a pressure channel 70 to a suction valve 71 of a combustion chamber 72 shaped in the head 66. In the combustion chamber there are a sparking plug 53 and a nozzle 52 for fuel supply. The head 66 is detached from the midcase 12 by means of a support plate 73. The suction valve 71 of the combustion chamber 72 is driven by a camshaft 43 connected with a gearing 50 to the main shaft 4. The horizontal operating cylinder 1 of the expanding first operating unit is connected to the combustion chamber 72 through its intake pipe 10, a rotation valve 74 and a relief channel 75. The rotation valve 74 is fixed to a driving shaft 76 that is attached to the gearing 50 connecting the main shaft 4 with the camshaft 43. The body of the rotation valve is a triangle with a vertex angle 2α, where α is the angle defined by the axes of the holes of the intake 10 and the exhaust 11 pipe forming a vertex in the main shaft.

When the device-operating module is used for active type of machines, and especially for piston and rotation internal combustion engines their structure is provided of a cooling fluid pump 77 and a lubrication pump 78, connected through the corresponding channels and placed as usual in the common casing 3 and the crankcase 2. All engine parts are subject to lubrication. The lubrication of the passive type machines is also a standard one.

Application of the Invention

In its first embodiment the operating module is an indivisible part of an internal combustion engine where the combustion process is performed by a vertical operating cylinder 47 and the transmission of the forces originated as a result of the pressure developed in it is made by the frame and the second operating package attached therein. The air mix is supplied through the suction valves 46 of the vertical operating cylinder and fills the overpiston space 51 thus opening the compression valves of the compression cylinders 45. After the above-mentioned valves 49 and 46 are closed and when the operating piston 41 reaches the top dead centre (TDC) the nozzle 52 supplies fuel to the overpiston space 51 and the spark-plug 53 generates an ignition spark. The pressure formed drives the operating piston 41 to the bottom dead centre (BDC) moving also the compression pistons 39 together with the operating piston 41 thanks to their common connection through the frame 19. When approaching the BDC the intake pipe 10 of the horizontal cylinder 1 is connected to the overpiston space 51 and part of the burnt gases reaches one of the chambers formed in the horizontal operating cylinder 1, exercising pressure over the cylindrical shaft 5 thus increasing the driving torque realized by the main shaft 4. After passing the BDC the operating piston 41 moves upwards, and the burnt gases follow their path to the horizontal operating cylinder 1 and maintain their pressure over the cylindrical shaft 5. Simultaneously, until the inlet to the intake pipe 10 is closed in the overpiston space 51 of the vertical operating cylinder 47, the suction valves 46 of the vertical operating cylinder 47 are opened and fresh air penetrates in the overpiston space 51 warmed up in the closed suction channels 48. This hot fresh air blows through the overpiston space 51 and thus prepares it for the next cycle. After the crown of the operating piston 41 passes through the inlet of the intake pipe 10 the compression in the overpiston space increases and the so-called compression valves 49 are opened and the new charging of the vertical operating cylinder 47 with air mix begins. By this time the burnt gases acting over the cylindrical shaft 5 have transmitted its energy and leave the horizontal operating cylinder 1 through the exhaust pipe 11. Simultaneously, while the first operating unit acts as described above, the second operating unit exercises the rotation of the main shaft 4, and the compression pistons 39 move in sync with the operating piston 41 and with the skirts 32 perform the reciprocating motion of the articulated joints 18 that make the external rings 17 of the friction bearings to perform a reciprocating and, simultaneously, fluctuating motion around the centre of the main shaft 4. With this motion the rotation of the cylindrical body 15 is performed that is fixed to the main shaft 4. In this embodiment the frame is located in the overpiston space 51 and is attached as mentioned above to the upper wall of the cylinder head 42 by means of elastic connections 57, and, in the specific performance, springs working on tension and pressure. The elastic connections 57 make it possible reduce the impact of the inertia forces in the top dead centre (TDC) that affect the articulated joint 18, thus making its operation easier.

In the second embodiment of the operating module it is also an indivisible part of an internal combustion engine where the combustion process takes place in the vertical operating cylinder 47 and the transmission of the forces formed by the pressure developed therein is made by the frame 19 and the attached to it second operating unit. The processes that develop in the cylinder head 42 and the valves therein are equal to those described in the first embodiment. The difference consists in the connection of the operating 41 and the compression valves 39 with the frame 19. This connection is performed in the bottom part of the pistons 41 and 39. The subpiston space 58 is common and is separated by a horizontal base 59 from the compartment where the operating units are placed. So the subpiston space 58 is a compression one and the compressed air is supplied through the second airduct 64 to the overpiston space 51 that is defined by the location of the operating piston 41 in the vertical operating cylinder 47 and a lamellar valve 69 provided that enables the air mix pass only from the subpiston space 58 to the overpiston space 51.

In the third embodiment of the operating module it is an indivisible part of a machine that may be either active, i.e. turbine or passive, i.e. pump or compressor. In this case, an external source of motion is needed to rotate both the main shaft 4 and the cylindrical shaft 5. During the rotation a suction is performed through the intake pipe 10 of the horizontal operating cylinder and a simultaneous displacement of valve 13, that has a through hole 68 in its upper part, opening and closing in a cycle the intake pipe 10 horizontally aligned in the midcase 12. The articulated joints 18 are attached to the frame 19 elongations 65 that is connected with the elastic connections 57, made as springs, operating at tension and pressure, to the upper part of the head 66. These springs 57 aid the rotation of the main shaft 4, and when it is outbalanced they always tend to set it back in its initial position, thus exercising an additional motion to obtain an additional driving torque, which is a factor that increases the power of the machine no matter if active or passive.

In the fourth embodiment of the device-operating module, illustrated on FIGS. 15 to 19, in the common casing 3 of the module are mounted two first operating units and a second operating unit between them. Arranged this way, the module is an indivisible part of a rotation internal combustion engine. The processes in this rotation engine are developed as follows: The air mix suctioned through the air filter is led to the compression first operating unit and is transported through a pressure channel and suction valve to the combustion chamber 72 where the fuel is transmitted and the burning process takes place. The air-fuel mix thus obtained, after being burnt and having developed a high pressure is led through the rotation valve 74 to the horizontal operating cylinder 1 of the expanding first operating unit, exercised pressure over the cylindrical shaft and rotates the main shaft 4 expanding and transmitting its energy, and at the end leaves the inner space of this horizontal operating cylinder 1 through its exhaust pipe. The rotation of the main shaft 4 drives the second operating unit and the inertia forces developed therein due to the mass of the cylindrical body 15 give an additional driving torque to the main shaft 4 thus increasing the engine power.

REFERENCES

1. Patent Application in Germany No. 22039408

The invention claimed is:

1. A device operating module comprising:

a first operating unit comprising a horizontal operating cylinder (1) and a cylindrical shaft (5) connected to the horizontal operating cylinder (1), attached to a main shaft (4) in a fixed and eccentric way; sealed with a small sealing ring (7) and a large sealing ring (8) to vertical walls of the horizontal operating cylinder (1); mounted on a spring first friction element (9) in to the cylindrical shaft (5), and abutting to an inner wall of the horizontal operating cylinder (1), and a second operating unit comprising a cylindrical body (15) mounted onto the main shaft (4) in an eccentric and fixed way with an inner ring (16) of a friction bearing tightly attached to a circumference of the cylindrical body (15);

wherein the friction bearing has an outer ring (17) being provided with an articulation joint (18), and wherein the articulation joint (18) is connected to a frame (19) and is on a distance/radius R4 from an axis of the friction bearing that is equal to a radius of the cylindrical shaft (5), as the first operating unit and the second operating unit are placed isolated in a common casing (3) of a crankcase (2), the main shaft (4) is mounted on bearings in walls of the horizontal operating cylinder (1) and in walls of the common casing (3);

wherein in the horizontal operating cylinder (1) and in the common casing (3) there are an intake (10) and an exhaust (11) pipes for supply and discharge of fluid;

wherein between the intake (10) and the exhaust (11) pipes in a groove of the common casing (3) is located a valve (13) with attached a second friction element (14) vertically pressed to the cylindrical shaft (5) and the valve (13) is attached to the frame (19);

wherein the spring first friction element (9) and the second friction element (14) form two chambers in the horizontal operating cylinder (1), which chambers are isolated one from another and constantly change their volume;

wherein to the main shaft (4) out of the horizontal operating cylinder (1) are mounted counterweights (20);

wherein an external surface of the cylindrical body (15) with a radius R3 during its motion is constantly placed under an axis of the articulation joint (18);

wherein an axis of the cylindrical body (15) draws a circumference with a radius R5 during operation; and wherein an radius of the inner cylindrical surface of the horizontal operating cylinder (1) is R1=R4+R5, and the axis of the articulation joint (18) is located in a vertical plane and set at an eccentricity distance E from the vertical plane where the axis of the main shaft (4) lays.

2. The device operating module of claim 1, characterized by that the first friction element (9) is attached to a bed of the cylindrical shaft (5) by a fixed to it bottom strip (22) where a collapsible thrust strip (23) with profiles guides (24) lays, the guides having a shape matching the outline of the bands' (21) end, attached to the cylindrical shaft (5) and corresponding to profile notches (25) in the spring first friction element (9), and to the thrust strip (23) are mounted three sets of located one over the other cap (26), spring (27) and cup (28) to which a support cylinder (29) is abutted, fixed to the first friction element (9), and on the bottom (30) parts of the cylindrical shaft (5), the first friction element (9) having a sealing plate (31) hold pressed to the horizontal operating cylinder (1) by means of elastic wafer (32).

3. The device operating module of claim 1, characterized by that the second friction element (14) attached to the valve (13) consists of other three sets of cap (33), spring (34) and the cup (35), the cup (35) being connected to the valve (13), and the support cylinders (29) are articulated in the valve (13) that is sealed in its groove by two opposite sealing plates (36), supported in a pressed position by elastic wafers (37), the shape of the valve (13) matching the outline of the corresponding transverse bands (21).

4. The device-operating module of claim 1, considered opposed and penetrating transverse bands (21), attached to the inner surface of the horizontal operating cylinder (i) in a section of the second friction element (14) and to the outer wall of the cylindrical shaft (5) in a section of the spring first friction element (9), that the said transverse bands (21) cover the spring first and second friction elements (9, 14) when they pass each other.

5. The device-operating module of claim 1, wherein in the common casing (3) of the module to the main shaft (4) are fixed two first operating units and one second operating unit between them and four counterweights (20), two of them being located on both sides of the second operating unit, and the other two are located externally to the first operating units, and one of the two operating units is a compression one, and the other is an expanding unit, and over the common casing (3) there is a midcase (12) fixed firmly, with a head (66) over it and in the midcase (12) are contained the intake (10) and exhaust (11) pipes of the horizontal operating cylinders (1), as well as the groove for the valve (13) with the second friction element (14), constantly pressed by the frame (19) against the cylindrical shaft (5) of the horizontal operating cylinder (1), the frame sliding free in the head (66), and the intake pipe (10) of the first operating compression unit is connected through a first airduct (63) with an air filter (62), and its exhaust pipe (11) is connected through a pressure channel (70) with a suction valve (71) of a combustion chamber (72) shaped in the head (66) where a spark plug (53) and a nozzle (52) for fuel supply are provided, and the horizontal operating cylinder (1) of the expanding first operating unit is connected to the combustion chamber (72) through its intake pipe (10), a rotation valve (74) and a relief channel (75).

6. The device operating module of claim 5, wherein the head (66) is detached from the midcase (12) by means of a support plate (73), and the suction valve (71) of the combustion chamber (72) is driven by a camshaft (73) connected with a gearing (50) to the main shaft (4).

7. The device operating module of claim 5, wherein the rotation valve (74) is fixed to a driving shaft (76) that is included into the gearing (50) connecting the main shaft (4) to the camshaft (43), the body of the rotation valve (74) being a triangle and its vertex angle 2$\alpha$ in the rotation axis is equal to the angle $\alpha$ defined by the holes of the intake (10) and exhaust (11) pipes forming a vertex in the main shaft (4).

* * * * *